United States Patent [19]

Agnoux et al.

[11] 4,054,813

[45] Oct. 18, 1977

[54] TRIGGERED SPARK-GAP DISCHARGER

[75] Inventors: Claude Agnoux, St. Germain les Arpajon; René Destrée, Orsay, both of France

[73] Assignee: Compagnie Generale d'Electricite S.A., Paris Cedex, France

[21] Appl. No.: 755,915

[22] Filed: Dec. 30, 1976

[30] Foreign Application Priority Data

Dec. 30, 1975 France ..... 75.40118

[51] Int. Cl.[2] ..... H01J 17/30

[52] U.S. Cl. ..... 313/198; 313/197

[58] Field of Search ..... 313/198, 197

[56] References Cited

U.S. PATENT DOCUMENTS 3,702,411 11/1972 Destree ..... 313/198

*Primary Examiner*—Rudolph V. Rolinec
*Assistant Examiner*—Darwin R. Hostetter
*Attorney, Agent, or Firm*—Sughrue, Rothwell, Mion, Zinn and Macpeak

[57] ABSTRACT

The invention relates to a spark-gap discharger triggered in a gas. The triggering discharge takes place on the edge of a thin dielectric sheet between two thin metal layers adhering to opposite surfaces of the dielectric sheet. Application to the reduction of the manufacturing cost and to the increase in triggering precision in terms of time of a spark-gap discharger.

13 Claims, 3 Drawing Figures

TRIGGERED SPARK-GAP DISCHARGER

FIELD OF THE INVENTION

The present invention relates to triggered spark-gap discharges and in particular to spark-gap dischargers which permit a high energy discharge (10 joules for example) in a very short time which can be counted in nanoseconds.

BACKGROUND OF THE INVENTION

Many triggered spark-gap dischargers are known involving in addition to principal electrodes (cathode and anode) between which the principal electric discharge takes place, two "triggering" electrodes. One of these triggering electrodes is often constituted by one of the principal electrodes.

A DC voltage (20 kv for example) can be applied between cathode and anode, for example by connecting the cathode and the anode to the terminals of a capacitor charged by the DC voltage. When the voltage is less than the breakdown voltage between the cathode and the anode and greater than a threshold voltage which is a function (as is the breakdown voltage) of the geometrical disposition of the spark gap and of the nature and pressure of the gas surrounding the electrodes, a suitable electric discharge between the triggering electrodes is sufficient for triggering the principal discharge. For this purpose, an impulse is applied between these electrodes at a voltage of a few KV for example. An electric "triggering discharge" then takes place between these electrodes and triggers the principal discharge.

One use of the spark-gap discharger is that the energy of the triggering impulse can be very much less than that of the principal discharge.

It is very often important to be able to trigger the spark-gap discharger by means of an electrical impulse having not only little energy but also a small potential difference, e.g. less than 2 kilovolts. Various solutions have been proposed for this purpose:

One consists in reducing the distance separating these triggering electrodes, it being understood that from this view-point, there is an optimum distance which depends on the nature of pressure of the ambient gas and below which it is useless and harmful to descend. In the case of atmospheric-pressure spark-gap dischargers this distance is in the order of about 10 microns. Great triggering precision in terms of time requires this distance to be made with precision. Now, considering the insulation which must be provided between the triggering electrodes, the creation and maintenance of a distance as small as this poses difficult design problems.

For the same purpose, it is also known to occupy the space between the triggering electrodes with a solid dielectric. The triggering discharge then takes place on the surface of this dielectric. In effect, an electrical discharge — preferably in a dielectric environment — follows the interfaces between dielectics of different kinds and more precisely, in the disposition described, the interface between the solid dielectric and the gaseous dielectric. This boils down to saying that the voltage necessary for breakdwon is diminished. Nevertheless, if this voltage is to be very small, it remains necessary to give the solid dielectric separating the triggering electrodes a small thickness. This is why it has been proposed in French Pat. No. 7,033,577 filed on Dec. 16, 1970, in the name of Compagnie Generale d'Electricite and in the corresponding U.S. Pat. No. 3,702,411, for a "Spark-gap discharger triggered in a gas" to provide this dielectric in the form of a thin sheet clamped between triggering electrodes which must be adjusted with precision.

Nevertheless, it remains desirable to simplify manufacture and to diminish further the triggering voltage without increasing the dispersion of the delay on triggering, i.e. the variations in the time which passes between the triggering pulse and the main discharge. The uncertainty of this delay is known as "jitter".

Preferred embodiments of the present invention provide a triggered spark-gap discharger having little dispersion of the triggering delay and a low triggering voltage while still involving only low production costs.

SUMMARY OF THE INVENTION

The present invention provides a triggered spark-gap discharger comprising:

two principal electrodes between which a DC electric voltage can be established;

and two triggering electrodes insulated from each other by a thin dielectric sheet and disposed near the principal electrodes so that when an electric triggering discharge takes place between these triggering electrodes, this causes a principal energy discharge between the two principal electrodes which is larger than that of the triggering discharge; and wherein said two triggering electrodes are constituted respectively by the edges of the two thin metal layers adhering to both surfaces of said thin dielectric sheet the assembly formed by these two layers and that dielectric sheet forming a thin metallized sheet, disposed so that said triggering discharge is produced on one of its edges between the two metal layers around the bare surface of the dielectric sheet.

Two non-limiting embodiments of the invention will be described hereinbelow with reference to the accompanying drawings.

Elements that correspond to each other in several of these figures have been given the same reference numerals therein.

DESCRIPTION OF THE PREFERRED EMBODIMENTS

Figure 1:
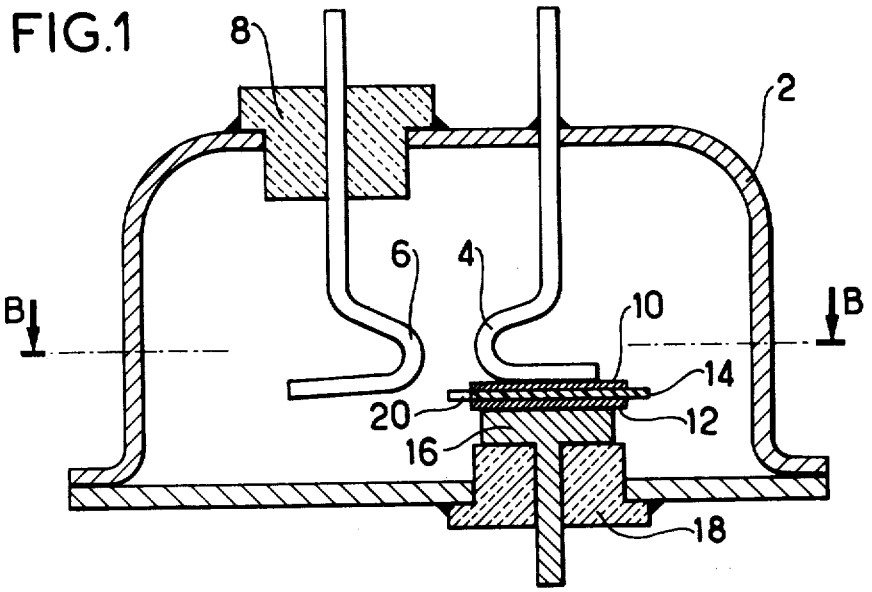
FIG. 1 is an axial cross-section, in a plane A, of a first spark-gap discharger embodying the invention.
Figure 2:
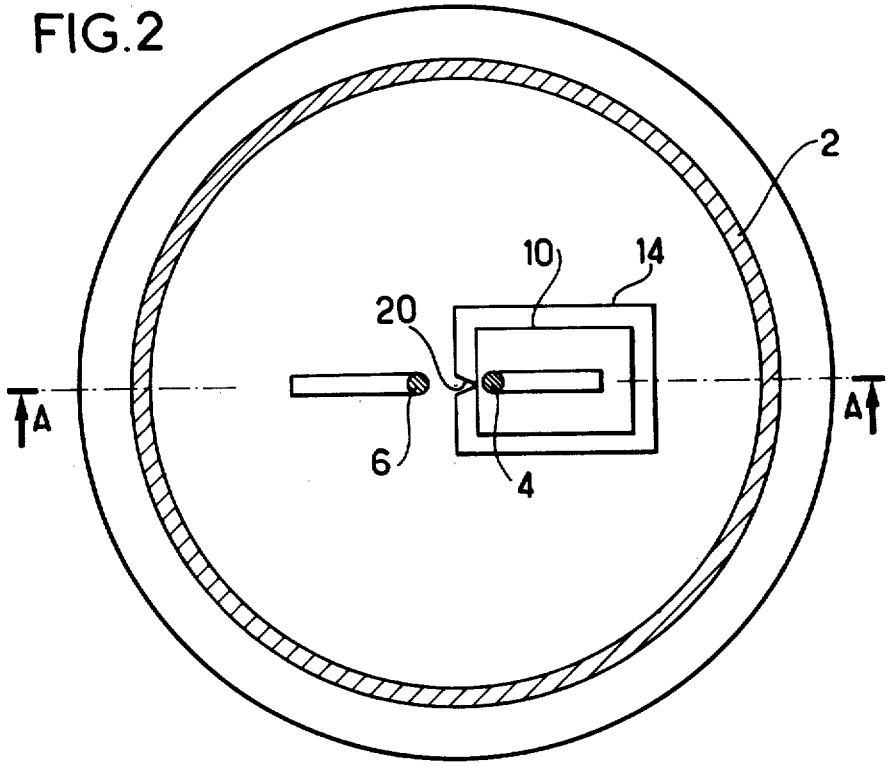
FIG. 2 is a cross-section view of the spark-gap discharger in FIG. 1, in a plane B perpendicular to the axis.

The spark-gap discharger shown in FIGS. 1 and 2 comprises a metal housing 2 enclosing two principal electrodes made of an iron-nickel or copper-nickel alloy and in the shape of two thick curved metal wires. These wires form an "adjacent" electrode 4 electrically connected to the housing 2 and an "opposite" electrode 6 which is electrically connected to the outside through an insulating bushing 8. The electrode 4 is called adjacent because it is close to the triggering electrodes which are constituted by two thin layers of copper 10 and 12 adhering to the two faces of a thin dielectric sheet 14 constituted by a polyimide, e.g. of the type sold by the firm "Dupont de Nemours" under the trade mark "KAPTON".

However it is possible to use other dielectric materials made in thin sheets, e.g. ethylene polyterephthalate known under the trade marks "MYLAR" and "TERPHANE". It seems preferable to use a non-porous high organic polymer having good transversal dielectric strength, higher than 50 KV/mm and preferably approximately 100 KV/mm in thin sheet form. It also seems preferable for it to have a degree of hardness so as to enable clean cutting.

In the example described, the sheet 14 and the layers 10 and 12 each has a thickness preferably lying between 10 and 200 microns and equal to approximately 50 microns in the example described. The sheet 14 is chosen proportionally thinner as it is required to obtain a lower electric triggering voltage. However, this voltage must not be lowered too much for the resulting energy would be too low for the triggering discharge. Further, the metallized sheet consisting of the sheet 14 coated with the layers 10 and 12 must preferably have some mechanical rigidity so that when it is fixed on a base and when it projects beyond that base, the position of the extending part will be well determined despite vibrations for example.

In the figures, the thicknesses of the sheet 14 and of the layers 10 and 12 are greatly exaggerated to make the drawing easier to understand.

One of the advantages of the present invention is that suitable metallized sheets such as the one which has been described are available in trade at a low cost for the production of resilient printed circuits, in particular for producing multiple resilient electric connections. Various methods such as simultaneous lamination or chemical deposition can be used to ensure the adherence of the copper sheets 10 and 12 on the dielectric sheet 14.

The metallized sheet 10, 14, 12 is elastically pressed by the curved end of the adjacent electrode 4 against a flat metal base 16, electrically connected to a first terminal of an external control circuit through an insulating bushing 18. The metal layer 10 is thus connected through the electrode 4 to the second terminal of the control circuit whereas the metal layer 12 is connected to the first terminal of this control circuit.

The metallized sheet 10, 12, 14 extends beyond the base 16 towards the opposite principal electrode 6, in such a way that one of its edges is disposed in the vicinity of the principal discharge zone situated between the two principal electrodes 4 and 6, where they are closest together. This edge is chosen for producing the triggering discharge. For this purpose, the dielectric sheet 14 projects peripherally beyond the metal layers 10 and 12 all around this sheet over a width of 3 mm for example. The non-metallized rim can be obtained easily by local chemical scouring of a completely metallized dielectric sheet found in trade. When this sheet is dipped in the scouring bath, it is held vertically so that the scoured width be the same on both surfaces of the sheet.

A pointed notch 20 is cut in the non-metallized edge in the vicinity of the principal discharge zone so that the point of this notch reaches the metal layers 10 and 12. The angle at the point of the notch 20 is approximately 45°. It does not matter if the point of the notch extends beyond the non-metallized edge and enters the metal layers 10 and 12 down to a depth of 0.1 and 0.2 mm. Such precision can easily be obtained.

The atmosphere inside the housing 2 can be constituted by dry nitrogen at atmospheric pressure.

Figure 3:
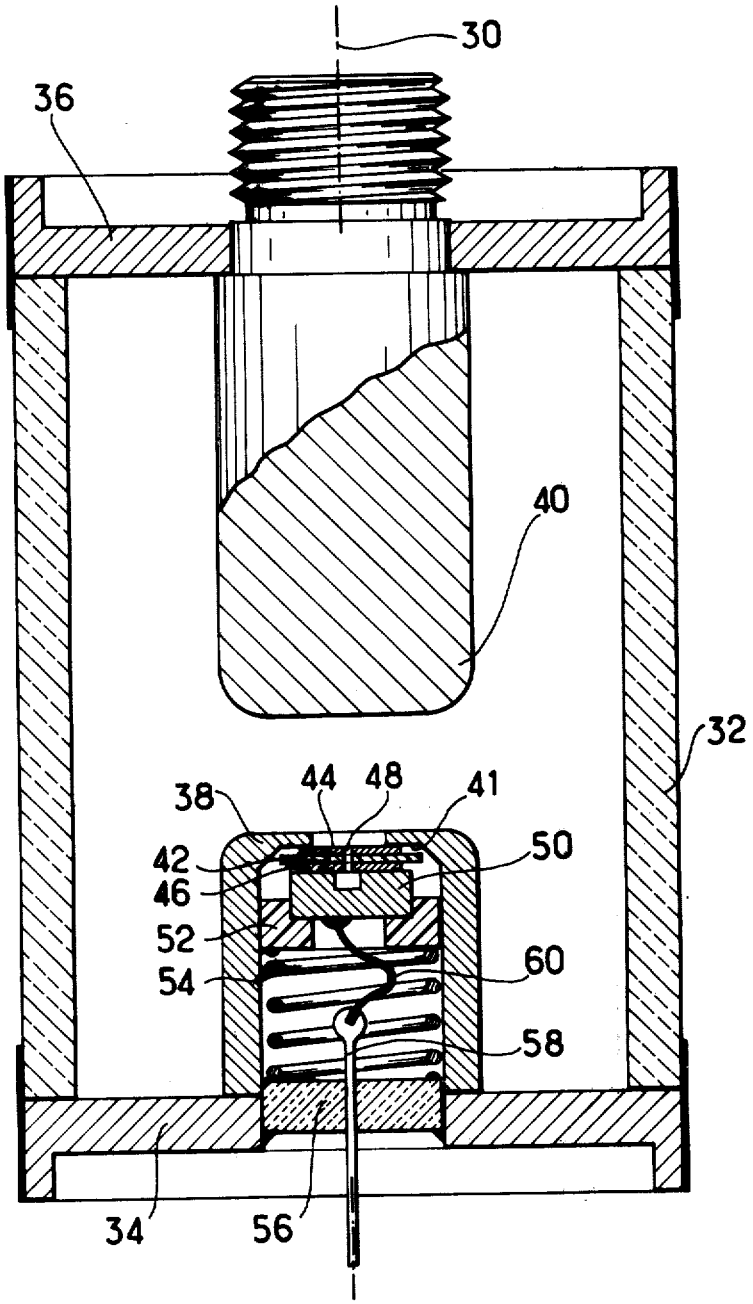
FIG. 3 is an axial, cross-sectional view of a second spark-gap discharger embodying the invention.

The spark-gap discharger shown in FIG. 3 is analogous to the one shown in FIGS. 1 and 2. However, it has circular symmetry about an axis 30. It is constituted by a cylindrical insulating sleeve 32 linking together two metal plates 34 and 36 connected to two circular principal electrodes disposed on the axis and made of stainless steel, molybdenum or tungsten-copper alloy.

They are a hollow "adjacent" electrode 38 and a solid "opposite" electrode 40 having two plane active surfaces facing each other. The active surface of the adjacent electrode 38 is perforated with an axial circular opening communicating with the internal space of this electrode. On the edges of this opening, this electrode has, towards the inside, a circlar crown-shaped plane surface. This internal surface is used as a bearing surface 41 for a metallized sheet with a circular shape consisting of a dielectric sheet 42 on both of whose surfaces adhere, two metal layers 44 and 46. The dielectric sheet 42 extends peripherally beyond and all around the metal layers 44 and 46. It is perforated at its centre by a hole 48 having a diameter of less than 0.5 mm and preferably smaller. This hole can be a pin hole for example. The metallized sheet 42, 44, 46 is pressed elastically against the surface 41 in contact with the layer 44 through a bearing part 50 in contact with the layer 46 and having a diameter of less than that of the cylindrical internal space of the electrode 38. The surface of this part in contact with the layer 46 is hollowed out in the vicinity of the hole 48.

The bearing part 50 is guided in the internal space of the electrode 38 by a ring 52 made of an insulating plastic material which bears on the cylindrical internal lateral wall of this electrode. This ring is pushed towards the bearing surface 41 by a helical spring 54 which presses against an insulating plug 56 which stops the internal space of the electrode 38 on the side nearest the plate 34. This plug is threaded by a metal wire 58 connected to the bearing part 50 by a resilient wire 60. It is understood that the triggering discharge takes place on the walls of the hole 48 between the triggering electrodes constituted by the metal layers 44 and 46. For this purpose, an external control circuit is connected between the plate 34 and the wire 58. The control circuit is connected between the plates 34 and 36.

The spark-gap dischargers which have just been described provide the following performances, for example:

| | |
|---|---|
| Voltage between the principal electrodes: | 1 to 30 kV |
| Energy of the principal discharge: | 1 to 12 joules |
| Triggering voltage: | 1 kV |
| Energy of the triggering discharge: | 1 mJ |
| Number of discharges: | 10,000 |
| Triggering delay: | 20 ns |
| Dispersion of the triggering delay (for a given spark gap) (jitter: 5 ns). | |

One great advantage of the present invention is the association of a low triggering voltage with a low dispersion of the triggering delay during successive discharges with a same spark-gap discharger. This enables great triggering precision in terms of time after testing and adjusting of the control circuit.

What we claim is:

1. A triggered spark-gap discharger comprising:

two, spaced principal electrodes for establishing a DC electric voltage therebetween;

two triggering electrodes insulated from each other by a thin dielectric sheet and disposed near the principal electrodes so that an electric triggering discharge taking place between these triggering electrodes causes a principal energy discharge between the two principal electrodes which is larger than that of the triggering discharge; and wherein said two triggering electrodes are constituted respectively by the edges of the two thin metal layers adhering to opposed surfaces of said thin dielectric sheet, said assembly being formed by these two layers and said dielectric sheet forming a thin metallized sheet and disposed so that said triggering discharge is produced on one of its edges between the two metal layers around the bare surface of the dielectric sheet.

2. A spark-gap discharger according to claim 1, further comprising:

a fixed base on which said metallized sheet is laid;

fixing means for fixing said metallized sheet onto the base; and connection means for providing the electrical connection of said metal layers;

and wherein said metallized sheet extends beyond the edges of the base for said triggering discharge to take place at a distance from the base and from said fixing means and connection means.

3. A spark-gap discharger according to claim 2, wherein said fixing means comprises a resilient means for pressing said metallized sheet onto said base, said resilient means and said base being metallic and constituting said electrical connection means for said metal layers.

4. A spark-gap discharger according to claim 1, wherein said dielectric sheet has a thickness lying between 10 and 200 microns.

5. A spark-gap discharger according to claim 4, wherein said dielectric sheet is constituted by a non-porous high organic polymer.

6. A spark-gap discharger according to claim 5, wherein said dielectric sheet is constituted by a polyimide.

7. A spark-gap discharger according to claim 4, wherein said metal layers are made of copper.

8. A spark-gap discharger according to claim 7, wherein said metal layer have a thickness lying between 10 and 200 microns.

9. A spark-gap discharger according to claim 4, wherein said dielectric sheet extends beyond said metal layers so as to form a non-metallized dielectric edge, said edge being provided at one point with a notch having a sharp angle so as to reduce its width at that point and to oblige the triggering discharge to take place at that point.

10. A spark-gap discharger according to claim 9, wherein said notch occupies substantially the width of said edge.

11. A spark-gap discharger according to claim 2, wherein said dielectric sheet extends beyond said metal layers so as to form a non-metallized dielectric edge surrounding it completely, said metallized sheet being perforated with a hole threading the dielectric sheet and the two metal layers so as to enable the triggering discharge to take place on the edge of the hole.

12. A spark-gap discharger according to claim 11, in which said two principal electrodes comprise an electrode "adjacent" to the triggering electrodes and an "opposite" electrode having respectively two substantially parallel active surfaces facing each other between which the principal discharge takes place, wherein the adjacent electrode is hollow and its active surface is perforated with an opening communicating with an internal space within said adjacent electrode, said metallized sheet being disposed in said internal space so as to close off said opening by extending beyond the edges of that opening and being applied from the inside against the electrode edges forming said opening so as to make one of said metal layers contact the internal surface of the adjacent electrode and the metallized sheet being perforated with a hole which is smaller than said opening.

13. A spark-gap discharger according to claim 12, wherein the diameter of the hole perforated in said metallized sheet is less than 0.5 mm.

* * * * *